US007014087B1

(12) United States Patent
White et al.

(10) Patent No.: US 7,014,087 B1
(45) Date of Patent: Mar. 21, 2006

(54) SUPPORT GUIDE FOR POWDER DRIVER BARREL

(75) Inventors: Michael L. White, Boaz, AL (US); Frederick James Diggle, III, Birmingham, AL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 189 days.

(21) Appl. No.: 10/687,151

(22) Filed: Oct. 16, 2003

(51) Int. Cl.
*B25C 1/12* (2006.01)

(52) U.S. Cl. ..... 227/10; 227/8; 227/9; 227/11; 411/441; 411/485

(58) Field of Classification Search ..... 411/441, 411/451.5, 453, 485; 227/8, 10, 11, 9, 156
See application file for complete search history.

(56) References Cited

U.S. PATENT DOCUMENTS

| | | | | |
|---|---|---|---|---|
| 83,913 | A | 11/1868 | Bradley | |
| RE9,440 | E | 11/1880 | Judd | |
| 279,113 | A | 6/1883 | Clow | |
| 304,618 | A | 9/1884 | Cullen | |
| 306,874 | A | 10/1884 | Thatcher | |
| 415,181 | A | 11/1889 | Wilcox | |
| 427,642 | A | 5/1890 | Wack | |
| 472,948 | A | 4/1892 | Gorton | |
| 479,058 | A | 4/1892 | Corscaden | |
| 543,121 | A | 7/1895 | Bates | |
| 601,849 | A | 4/1898 | Aiken | |
| 682,753 | A | 9/1901 | Teele | |
| 908,320 | A | 12/1908 | Page | |
| 975,235 | A | 11/1910 | Hansen | |
| 1,057,448 | A | 4/1913 | Nordstrom | |
| 1,242,122 | A | 10/1917 | Apel | |
| 1,313,795 | A | 8/1919 | Davis | |
| 1,491,203 | A | 4/1924 | Walter | |
| 1,518,900 | A | 12/1924 | Colbert | |
| 1,610,082 | A | 12/1926 | Francis | |
| 1,736,707 | A | 4/1929 | Lake | |
| 1,779,339 | A | 10/1930 | Sokoloff | |
| 1,798,468 | A | 3/1931 | Hartzler et al. | |
| 1,953,880 | A | 4/1934 | Kraatz | |
| 2,043,716 | A | 6/1936 | Sloan | |
| 2,188,084 | A | 1/1940 | Kuckuck | |
| 2,257,640 | A | 9/1941 | Muller | |
| 2,307,348 | A * | 1/1943 | Anderson | 411/487 |
| 2,697,857 | A | 12/1954 | Eckel | |
| 3,061,835 | A | 11/1962 | Haln | |
| 3,088,361 | A | 5/1963 | Hallock | |
| 3,178,971 | A | 4/1965 | Bachli et al. | |
| 3,298,459 | A | 1/1967 | Bergsten | |
| 3,341,651 | A | 9/1967 | Odegaard | |

(Continued)

OTHER PUBLICATIONS

U.S. Appl. No. 10/646,204 filed Aug. 22, 2003.

(Continued)

*Primary Examiner*—Stephen R. Gerrity
*Assistant Examiner*—Thanh Truong
(74) *Attorney, Agent, or Firm*—Lee & Hayes, PLLC

(57) ABSTRACT

A powder driven tool includes a housing including a powder cartridge and a piston within a barrel. A guide member attaches to the barrel and cradles a support device. The guide member includes a wall portion having a thickness greater than other portions of the guide member. Ignition of the powder cartridge causes the piston to move within the barrel and drive the support device. The wall portion resists barrel climb as the support device is driven into an object.

15 Claims, 3 Drawing Sheets

U.S. PATENT DOCUMENTS 3,483,790 A 12/1969 Matthews
3,690,536 A * 9/1972 Bakoledis ..... 227/10
3,848,080 A 11/1974 Schmidt
3,934,802 A 1/1976 Jennings
4,018,023 A 4/1977 Anderson
4,068,790 A 1/1978 Osterle et al.
4,157,001 A 6/1979 Pickles
4,289,058 A 9/1981 Paskert
4,413,706 A 11/1983 Michael
4,438,769 A 3/1984 Pratt et al.
4,449,612 A 5/1984 Southard
4,479,599 A * 10/1984 Conrad ..... 227/9
4,655,380 A 4/1987 Haytayan
4,655,423 A 4/1987 Schavilje et al.
4,697,669 A 10/1987 Bergsten
4,830,254 A * 5/1989 Hsu ..... 227/10
4,979,858 A * 12/1990 Van Allman et al. ..... 411/441
5,062,753 A * 11/1991 Begue ..... 411/470
5,135,150 A 8/1992 Chun
5,207,404 A * 5/1993 Reinhard ..... 248/217.4
5,269,450 A * 12/1993 Popovich et al. ..... 227/10
5,279,388 A 1/1994 Laughlin et al.
5,417,534 A * 5/1995 Losada ..... 411/441
5,513,935 A 5/1996 Sharber et al.
5,549,234 A 8/1996 Hong
5,606,832 A 3/1997 Keith et al.
5,624,007 A 4/1997 Mahaffy
5,881,837 A 3/1999 Leicht
5,887,677 A 3/1999 Malmgren
5,899,124 A 5/1999 Cross, Jr.
5,944,139 A 8/1999 Kozial
5,967,475 A 10/1999 Johnson
6,126,055 A * 10/2000 Gantner et al. ..... 227/10
6,439,343 B1 * 8/2002 Jorges et al. ..... 182/92
6,484,888 B1 11/2002 Miller
6,585,142 B1 7/2003 Chen
6,726,162 B1 4/2004 Winter
6,729,437 B1 5/2004 Apple
6,872,042 B1 * 3/2005 Panasik et al. ..... 411/481
6,918,222 B1 7/2005 Lat et al.
2002/0098062 A1 7/2002 Beale et al.
2002/0121406 A1 9/2002 Summers
2003/0140739 A1 7/2003 McKivigan
2004/0064932 A1 4/2004 Sprague
2004/0099300 A1 5/2004 Warren
2004/0129496 A1 7/2004 Clark

OTHER PUBLICATIONS

U.S. Appl. No. 10/646,006 filed Aug. 22, 2003.
U.S. Appl. No. 10/646,068 filed Aug. 22, 2003.
U.S. Appl. No. 10/643,177 filed Aug. 18, 2003.
U.S. Appl. No. 10/643,177 filed Aug. 18, 2003, Fred Diggle, Knox Faulkner.
U.S. Appl. No. 10/346,204 filed Aug. 22, 2003, Andrew Barmakian, Bruce B. Barmakian.
U.S. Appl. No. 10/646,088 filed Aug. 22, 2003, Michael L. White, Frederick James Diggle, III.

* cited by examiner

SUPPORT GUIDE FOR POWDER DRIVER BARREL

FIELD

The invention, in various embodiments, relates generally to devices and methods for their manufacture and use in working on, for example, utility poles.

BACKGROUND

In the telecommunications or electronics industry, it is common practice for a technician (also referred to as a "linesman") to scale a utility pole. The technician scales the utility pole to install equipment, to repair broken or damaged communications equipment, to test equipment, and/or for other work-related reasons. To safely and effectively scale a pole and perform line work, the technician must maintain and properly utilize various types of scaling and safety equipment. To utilize the various types of scaling and safety equipment, the technician must also have the skills and the physical ability to sustain a great strain on their legs and back while the technician climbs and/or maintains a position about the pole.

Conventional climbing equipment employed by a technician typically includes a pair of gaffs, a body belt, and/or a safety strap. In general, the gaff is a sharp blade protruding from the inside of the foot about mid-foot level and having straps that secure about the leg and/or feet of a technician. To climb, the technician drives one of the gaffs into the pole, steps up onto the gaff, and then drives the other gaff into the pole at a higher position. The technician continues taking steps up or "gaffs up" the pole until reaching a desired height.

The body belt is secured around the waist of the technician. The body belt includes pockets for carrying tools and rings (e.g., "D-rings") for attaching the safety strap. The safety strap typically includes a hook (e.g., snap buckle) at each end and a buckle for adjusting its length. During climbing, both hooks of the safety strap are attached to the same ring of the body belt on the left hip. Once in a position to perform line work, the technician releases one end of the safety strap from the body belt. The technician then wraps the safety strap around the pole and reattaches the end of the safety strap to the body belt, thus allowing the technician to use his hands at the desired working elevation. Thus, the technician uses the safety strap for climbing as well as supporting the technician in his working position about the pole.

During elevated line work, both gaffs are pressed into the pole and the technician leans back against the safety strap. This position allows the weight of the technician to be supported by the gaffs and the tension in the safety strap.

SUMMARY

In one general aspect, a powder driven tool includes a housing including a powder cartridge and piston within a barrel. A guide member attaches to the barrel and cradles a support device. The guide member includes a wall portion having a thickness greater than other portions of the guide member. Ignition of the powder cartridge causes the piston to move within the barrel and drive the support device. The wall portion resists barrel climb as the support device is driven into an object.

In another general aspect, a guide member includes an attachment portion for connecting to a barrel of a powder driven tool. The powder driven tool includes a powder cartridge that actuates a piston within the barrel so that the piston drives a support device into an object. The guide member further includes a wall portion having a thickness greater than other portions of the guide member that resists barrel climb as the support device is driven into the object.

In another general aspect, a support assembly includes a powder driven tool and a support device. The powder driven tool includes a powder cartridge, a trigger for actuating a piston within a barrel, and a guide member attached to the barrel. The support device is adapted to received force applied from the piston for driving the support device into a pole. The guide member includes a slot for engaging the support device so that the support device is driven in a straight direction.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

DETAILED DESCRIPTION

It can be appreciated that commercial entities and other organizations that employ workers in elevated environments are aware of the potential risks attendant upon work performed in such environments. In view of this awareness, commercial entities and other organizations devote time and resources to promoting the safety of workers performing work in elevated environments to make the performance of work as safe as possible. Promoting safety of workers in elevated environments may involve instituting training programs and/or providing workers with a variety of support devices, support systems, backup devices and systems, and/or other means that promote the stability and safety of workers in elevated environments. Despite the best efforts of an organization to enhance the safety of its workers and reduce the risk of falling from elevated structures, for example, it is nonetheless difficult to eliminate all risks to workers performing work on such elevated structures.

Redundant systems for promoting safety of workers on elevated utility structures may thus sometimes be used. Such redundant systems can sometimes be beneficial in addition to the myriad of existing support systems, methods, devices and/or other apparatus employed by workers on elevated structures to reduce or mitigate risks associated with falling from utility structures, for example.

Figure 1B:
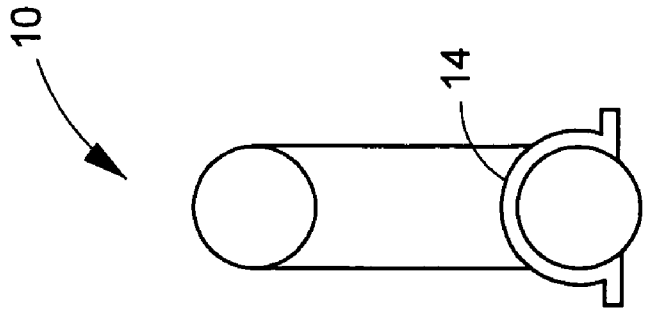
FIGS. 1A and 1B illustrate one embodiment of a support device.
Figure 1A:
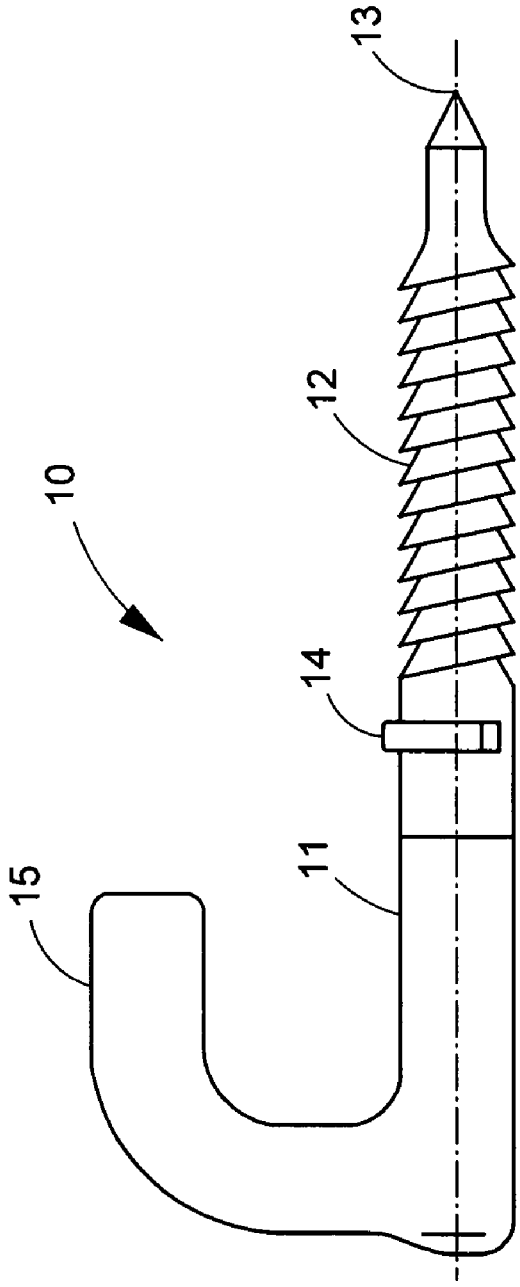

Referring to FIGS. 1A and 1B, one embodiment of a support device 10 is illustrated. It can be appreciated that the choice of materials for construction of the support device 10 may be driven, at least in part, by the motivation to create an apparatus that is relatively lightweight, relatively compact and structurally sound and suitable for supporting items as intended during the use of such an apparatus. Materials for the support device 10 may include, where appropriate and suitable for the reasonably safe and functional practice of the various embodiments described herein, one or more of the following materials: metals such as steel, aluminum, for example, titanium and/or stainless steel or any other metal or alloy capable of withstanding stress and strain.

In general, the support device 10 may be structured and arranged to support various items including, but not limited to, equipment, hardware, and/or safety equipment used by a technician when performing elevated line work, for example. In one embodiment, the support device 10 includes a shaft 11 having threads 12 and a pointed tip 13. In one implementation, the threads 12 may be used to secure the support device 10 into a utility pole, tree trunk, wall, rock face or any other vertical or columnar object, member or structure capable of receiving a support device 10, as described herein. It can be appreciated that the threads 12 may be replaced with any securing means to retain the shank in a utility pole or structure, such as barbs or teeth disposed about the shaft 11.

In one embodiment, the support device also includes a removable guide clip 14 positioned on the shaft 11 distally from the threads 12. In general, the guide clip 14 is structured and arranged to guide the support device 10 when driving the support device 10 into a utility pole, for example.

As shown, the support device 10 further includes a curved portion 15 extending from the shaft 11. The curved portion 15 may be formed, in one embodiment, by bending the curved portion 15 into the desired shape by any means known in the metalworking art. After forming the curved portion 15, it may be necessary to apply metallurgical techniques to the support device 10 to achieve the desired strength and rigidity. In one example, the fully formed support device 10 may be stress-relief annealed to improve its metallurgical qualities.

Figure 2:
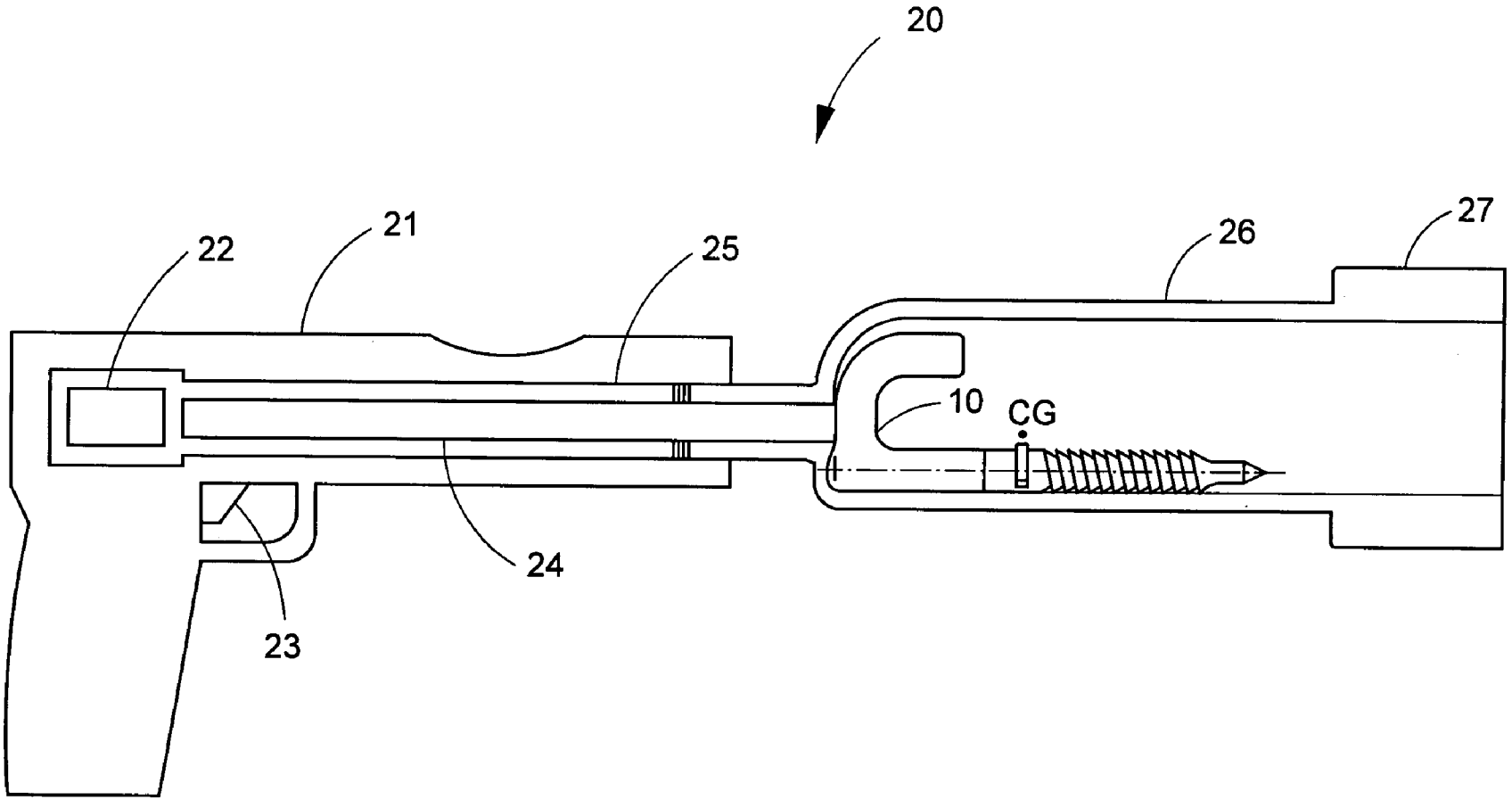
FIG. 2 illustrates one embodiment of a support device and driver assembly.

FIG. 2 illustrates one embodiment of a support device and driver assembly. In one implementation, a technician may drive the support device 10 into a utility pole using a powder driver 20, such as a powder-actuated tool, for example. Using a powder driver 20 to drive the support device 10 into a utility pole may be more efficient than using a large, heavy hammer.

In one embodiment, the powder driver 20 includes a housing 21, a powder cartridge (powder load) 22, and a trigger 23 for actuating a piston 24 within a barrel 25. As shown, the powder driver 20 also includes a guide member 26 fitted to the end of the barrel 25 for cradling a support device 10. In this embodiment, threads are used to fit the guide member 26 to the barrel 25.

In one implementation, the powder cartridge 22 is loaded into the powder driver 20 and the support device 10 is placed into the guide member 26. A technician positions the powder driver 20 for firing by pressing the guide member 26 against a utility pole (or other target) and applying enough pressure to release a safety. Once the safety has been released, the technician then pulls the trigger 23 causing a firing pin to release and strike the powder cartridge 22. The powder in the cartridge 22 ignites and burns releasing a burst of expanding gas that drives the piston 24 within the barrel 25. The piston 24 strikes and drives the support device 10 through the guide member 26 and into the utility pole.

In one embodiment, the piston 24 is structured and arranged so as to be located directly behind the center of gravity of the support device 10. In some embodiments, the tip of the piston 24 is molded to conform to the lower rear face of the support device 10. When the trigger 23 is pulled, the piston 24 accelerates the support device 10 to maximum velocity. When the tip 13 of the support device 10 touches the face of the pole, the support device begins to decelerate.

Upon entry, a moment (or couple) is applied to the support device 10 because the center of gravity is slightly above the resisting entry force. This moment tends to rotate the support device 10. However, the tendency to rotate is resisted by the moment of inertia of the support device 10 and by the top of the opening of the guide member 26.

In one embodiment, the guide member 26 includes a bull barrel 27. In general, the bull barrel 27 includes a thicker wall portion having a higher mass than other portions of the guide member. In one implementation, the high-mass bull barrel 27 resists barrel climb caused by the moment of the support device 10.

Figure 3B:
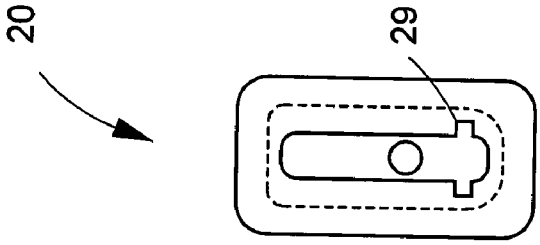
FIGS. 3A and 3B illustrate one embodiment of a support device and driver assembly.
Figure 3A:
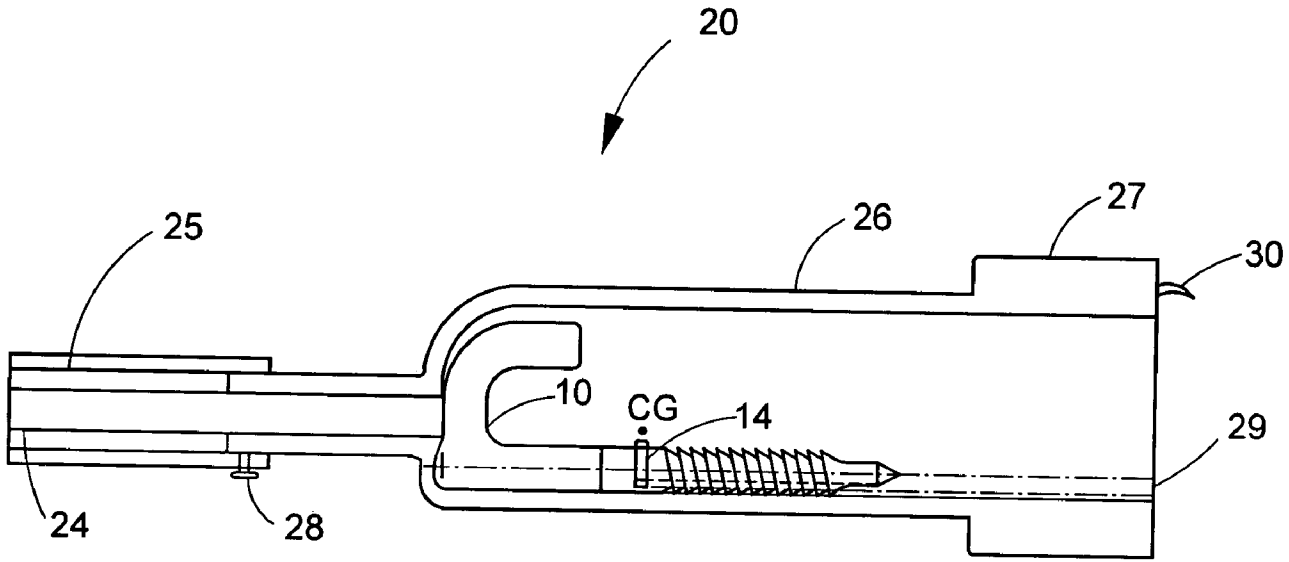

FIGS. 3A and 3B illustrate another embodiment of a support device and driver assembly. As shown, the power driver 20 includes a guide member 26 fitted to the end of the barrel 25 for cradling a support device 10. In this embodiment, a set-screw 28 is used to fit the guide member 26 to the barrel 25.

In one implementation, the piston 24 is structured and arranged so as to be located directly behind the center of gravity of the support device 10. The guide member 26 includes a bull barrel 27 that resists barrel climb caused by the moment of the support device 10.

In one implementation, a powder cartridge is loaded into the powder driver 20 and the support device 10 is placed into the guide member 26. A technician positions the powder driver 20 for firing by pressing the guide member 26 against a utility pole (or other target) and applying enough pressure to release a safety. Once the safety has been released, the technician then pulls a trigger 23 causing a firing pin to release and strike the powder cartridge. The powder in the cartridge ignites and burns releasing a burst of expanding gas that drives the piston 24 within the barrel 25. The piston 24 strikes and drives the support device 10 through the guide member 26 and into the utility pole.

In one embodiment, the support device 10 includes a removable guide clip 14, and the guide member 26 includes a slot 29 for engaging a guide clip 14. In one implementation, the guide clip 14 and slot 29 are structured and arranged to guide the support device 10 in a straight direction when driving the support device 10 into a utility pole. In some embodiments, the guide member 26 includes a small gaff 30 positioned on the end of the bull barrel 27 for increasing the coefficient of friction between the guide member 26 and the pole and further reducing barrel climb.

In general, the velocity of the piston 24 and driving force of the support device 10 depends on the powder load. In one embodiment, the powder load includes a 32-caliber blank. In other embodiments, the powder load may be greater or less depending on the material in which the support device 10 is to be driven. In some embodiments, the powder driver 20 may have an adjustable power level. In general, adjusting the power level changes the volume of the piston chamber to control piston velocity.

In one implementation, the powder driver 20 may be a single-shot tool. That is, after each shot is fired, a new powder cartridge 22 must be loaded into the powder driver 20. In other implementations, the powder driver 20 may be a semi-automatic tool having a multi-shot powder cartridge.

In one embodiment, the powder driver 20 may be mounted on an extension pole (not shown). This design may allow a technician to drive a support device 10 into an elevated portion of a utility pole while standing on the ground.

It can be appreciated that the design and/or use of support device 10 and powder driver 20 may be required to comply with applicable manufacturing and/or operating standards such as those set forth by the Powder Actuated Tool Manufacturers Institute (PATMI) and American Society of Testing and Materials (ASTM). Furthermore, technicians may be required to be trained and licensed to use the powder driver 20. In addition, technicians also must be equipped with suitable eye, ear, and face protection during use of the powder driver 20.

In one implementation, a technician may drive the support device 10 into a utility pole using a powder driver 20 such that the curved portion 15 projects outwardly from the pole and the threads 12 and pointed tip 13 are embedded in the pole. After securing the support device 10, the technician then may support various items including, but not limited to, equipment, hardware, and/or safety equipment used when performing elevated line work, for example.

The examples presented herein are intended to illustrate potential implementations of the present method and system embodiments. It can be appreciated that such examples are intended primarily for purposes of illustration. No particular aspect or aspects of the example method and system embodiments described herein are intended to limit the scope of the present invention. The configuration and specific functions of a particular support device or driver, for example, are provided merely for convenience of disclosure.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein.

It can be appreciated that, in some embodiments of the present methods and systems disclosed herein, a single component can be replaced by multiple components, and multiple components replaced by a single component, to perform a given function. Except where such substitution would not be operative to practice the present methods and systems, such substitution is within the scope of the present invention.

Whereas particular embodiments of the invention have been described herein for the purpose of illustrating the invention and not for the purpose of limiting the same, it can be appreciated by those of ordinary skill in the art that numerous variations of the details, materials and arrangement of parts may be made within the principle and scope of the invention without departing from the invention as described in the appended claims.

The invention claimed is:

1. A powder driven tool comprising:

a housing including a powder cartridge and piston within a barrel; and a guide member attached to the barrel and cradling a support device, the guide member including a wall portion having a thickness greater than other portions of the guide member, the wall portion defining a cavity having an oblong perimeter to accommodate the support device, wherein ignition of the powder cartridge causes the piston to move within the barrel and drive the support device in an axial direction, and the wall portion resists barrel climb as the support device is driven into an object, and wherein the guide member includes a slot formed in a side of the cavity and extending in the axial direction for engaging the support device so that the support device is driven in a straight direction.

2. The tool of claim 1, further comprising the support device, wherein the support device comprises a removable guide clip for engaging the slot formed in the side of the cavity.

3. The tool of claim 1, wherein the guide member includes a gaff protruding from a distal end of the guide member.

4. The tool of claim 1, wherein the guide member and barrel are connected by at least one of threads and a screw.

5. The tool of claim 1, further comprising the support device, wherein the support device comprises:

a shaft having a first end and a second end;

threads disposed at the first end of the shaft for use in securing the device to a pole; and at least one rigid support member disposed on the second end of the shaft.

6. The tool of claim 5, further comprising the support device, wherein the support device comprises at least one of stainless steel and titanium.

7. The tool of claim 5, the support device further comprising a removable guide clip positioned distally of the threads on the shaft.

8. The tool of claim 5, wherein the rigid support member of the support device comprises a curved portion.

9. The tool of claim 1, wherein the piston is molded to conform to a shape of the support device.

10. The tool of claim 1, wherein the guide member includes a gaff protruding from a distal end of the guide member for increasing the coefficient of friction between the guide member and the object into which the support device is driven, the tool further comprising the support device, wherein the support device is comprised of at least one of stainless steel and titanium and comprises a shaft having a first end and a second end, threads disposed at the first end of the shaft for use in securing the device to a pole, at least one rigid support member disposed on the second end of the shaft and including a hook-shaped portion, and a removable guide clip positioned distally of the threads on the shaft for engaging the slot formed in the side of the cavity, wherein the guide member and barrel are connected by a screw, and wherein the piston is molded to conform to a shape of the support device.

11. A support assembly comprising:

a powder driven tool including a powder cartridge, a trigger for actuating a piston within a barrel, and a guide member attached to the barrel, the guide member defining a cavity having an oblong perimeter; and a support device cradled in the cavity in the guide member and adapted to receive force applied from the piston for driving the support device into a pole, wherein the guide member includes a slot formed in a side of the cavity and extending in the axial direction for engaging the support device so that the support device is driven in a straight direction.

12. The support assembly of claim 11, wherein the guide member comprises a wall portion having a thickness greater than other portions of the guide member.

13. The support assembly of claim 11, wherein the guide member comprises a gaff protruding from a distal end of the guide member.

14. The support assembly of claim 11, wherein the support device comprises a curved portion.

15. The support assembly of claim 11, wherein the support device comprises a removable guide clip.

* * * * *